US005936544A

United States Patent [19]

Gonzales et al.

[11] Patent Number: 5,936,544

[45] Date of Patent: Aug. 10, 1999

[54] WIRELESS ACCESS SYSTEM

[75] Inventors: Eric V. Gonzales; Dennis Charlesbois, both of Aurora; Frederick J. Conforti, Wheaton; Ming Ng, Chicago; Cornelio M. Varilla, Des Plaines, all of Ill.

[73] Assignee: Pittway Corporation, Chicago, Ill.

[21] Appl. No.: 08/941,153

[22] Filed: Sep. 30, 1997

[51] Int. Cl.[6] ..... H01B 1/00

[52] U.S. Cl. ..... 340/825.34; 340/825.31; 70/276; 70/277; 70/278; 109/6; 109/53; 109/56; 235/380; 235/382; 235/382.5

[58] Field of Search ..... 340/825.31, 825.34; 70/276–78; 235/376, 380, 382, 382.5, 492; 109/6, 53.6, 81

[56] References Cited

U.S. PATENT DOCUMENTS 5,491,471 2/1996 Stobbe ..... 340/825.34

5,774,059 6/1998 Henry et al. ..... 340/825.31

*Primary Examiner*—William A. Cuchlinski, Jr.

*Assistant Examiner*—Yonel Beaulieu

*Attorney, Agent, or Firm*—Rockey, Milnamow & Katz, Ltd.

[57] ABSTRACT

A modular door access control system incorporates a plurality of wireless door modules. Access request signals are transmitted to a remote access control unit. The control unit transmits access authorizing control signals to a respective one of the modules. A newly installed module, in a selected mode, enters into communication with the unit. The unit in turn transmits an identifier to the module for use in identifying itself to the unit subsequently in response to a received access request.

61 Claims, 6 Drawing Sheets

WIRELESS ACCESS SYSTEM

FIELD OF THE INVENTION

The invention pertains to access control systems. More particularly, the invention pertains to modular door modules which are wirelessly coupled to an access authorizing unit.

BACKGROUND OF THE INVENTION

It is known to control access to a region by means of door access control systems. Known systems include door mounted lock modules which are connected by wires to a control interface. The interface functions as a multiplexer or concentrator and is in turn coupled to an access control unit.

Each door has associated therewith a manually operable input device such as a keypad or card reader. An individual desiring access enters a code which is forwarded by wiring to the control interface and then onto the access control unit for authorization. If the individual is authorized, the access unit signals the respective module to unlock the respective door thereby permitting access.

Alternate known systems include self-contained door mounted modules which make access decisions locally. They do not need to communicate with remote units.

Known wired units tend to be expensive and complex to install in view of a need to physically connect each door mounted module to a remote device by wiring. Self-contained systems are inconvenient when there are large numbers of access points or when there is a changing population of authorized individuals.

There continues to be a need for more cost-effective, versatile authorizing systems. Preferably such systems would incorporate non-wired remote modules while at the same time providing over-all common control and a common access data base that is usable with all devices or regions being monitored. It would also be advantageous if additional modules could be easily incorporated into such a system.

SUMMARY OF THE INVENTION

An authorization control system incorporates a plurality of wireless control modules. A module can be mounted on any locked entrance to or from a region. Alternately, a module can be used to provide access to a selected function or a capability. Examples include access to vending machines, data transmission or reception functions, access to computer systems, or other types of hardware such as copiers or printers.

An authorization requesting device is conveniently located. Such devices, which could be incorporated into a respective module, or, wirelessly coupled thereto, enable a requestor to provide identification data. Representative devices include card readers, keypads, voice detectors, palm or finger print scanners.

The modules are each in wireless communication with a common authorizing unit. To provide for ease of expansion or replacement, each module can be placed into a transient identifier or address requesting state. In response to entry into that state, the respective module transmits an identifier or address request to the authorizing unit. The authorizing unit, in turn, responds by transmitting an identifier or address to the requesting module.

The authorizing unit incudes a data base of authorized entities. The entities can have various, potentially limiting attributes associated therewith. These include currency limitations, function limitations, region, time or duration limitations.

The authorizing unit, as a result of assigning identifiers or addresses is able to recognize that plurality of modules which can properly request authorization. Modules having identifiers assigned by another authorizing unit or, as yet have no assigned identifier are not permitted to provide the requested authorization. Identifiers can be stored by the unit in a data base or recognized by other types of processing.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
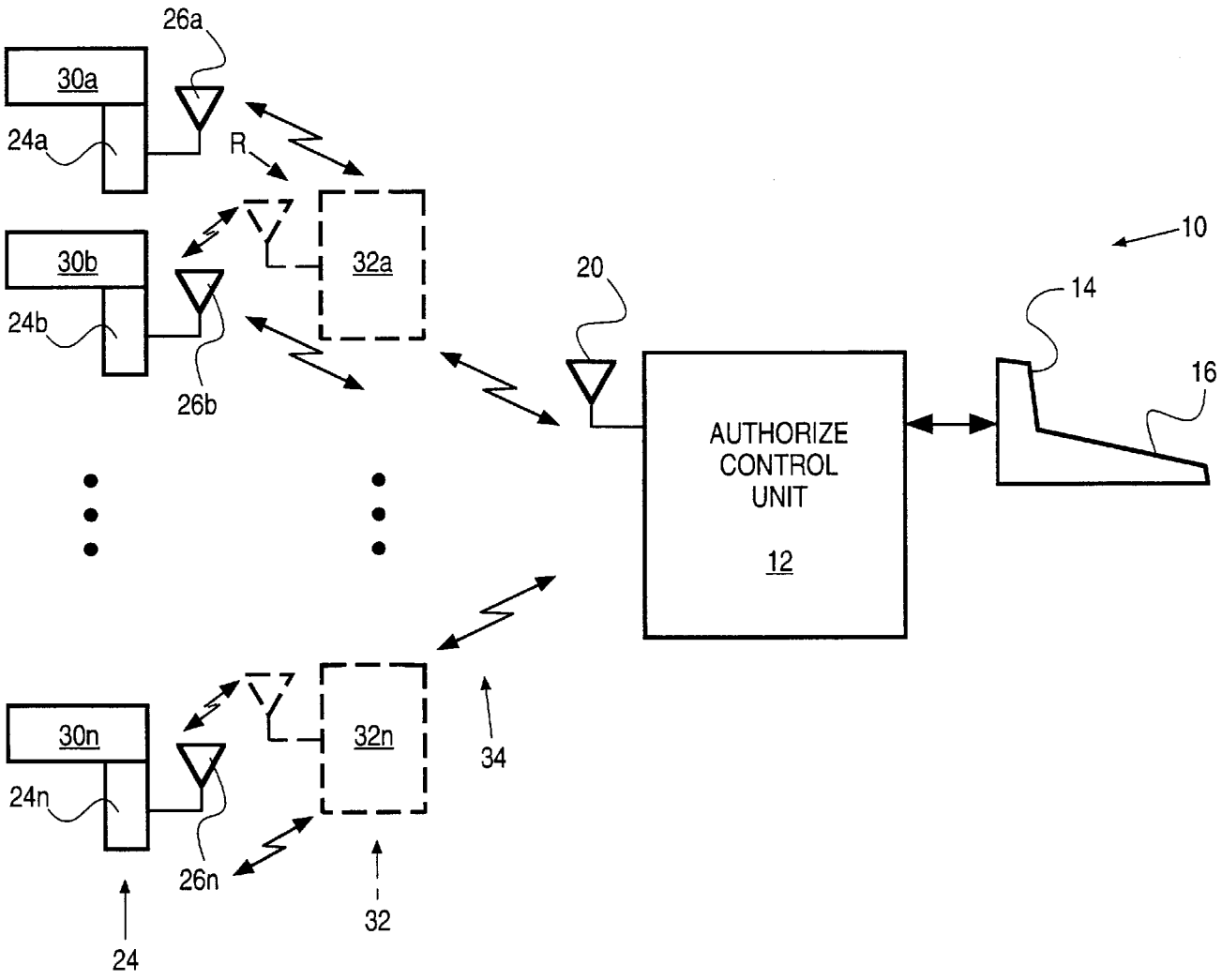
FIG. 1 is an over-all block diagram of the system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

As illustrated in FIG. 1, a system 10 includes an authorization control unit 12 to which is coupled an operator display device 14. The device 14 can also include an operator manipulatable keyboard 16.

The control unit 12 can incorporate one or more transceivers and one or more antennas, illustrated as an antenna 20. Where the control unit 12 incorporates transceivers and antennas, such as the antenna 20, that unit is able to communicate wirelessly, for example by RF transmission and reception, with a plurality of spaced-apart, remotely located, authorizing modules 24. The members of the plurality 24 such as authorizing modules 24*a*, 24*b* . . . 24*n* each include a transceiver and a respective antenna, such as the antennas 26*a*, 26*b* . . . 26*n* for purposes of carrying on bidirectional communication with the unit 12. Each of the remote authorization modules 24 is coupled to an apparatus 30*a*, 30*b* . . . 30*n* for which, in some sense, authorization may be sought.

For example, 30*a* . . . 30*n* could be movable doors or panels wherein the system 10 controls access to or from a region. In such an implementation, the authorization granting modules 24 could each be mounted on or at a respective door or panel member 30. In response to an authorization signal from the control unit 12, the respective module 24*i* could provide an authorization signal to a respective lock, thereby unlocking same. The respective door 30*i* could then be opened for ingress into the region being supervised.

It will be understood that the invention is not limited to implementing door access control systems. In fact it can be used to provide authorization for other types of units including vending machines, service providing devices such as juke boxes, copy machines, information providing units and the like, all without limitation.

As an alternate, the system 10 can be equipped with concentrators or multiplexers, 32*a* . . . 32*m,* illustrated in phantom. In such an instance, the respective concentrator or multiplexer can be in direct wireless communication with one or more of the modules 24. In such an installation, the concentrators or multiplexers 32 could be coupled to the control unit 12 by cables or by wireless communication which is indicated generally at 34. It will be understood that the form of coupling between the concentrators 32 and the control unit 12 is not a limitation of the present invention.

Figure 2:
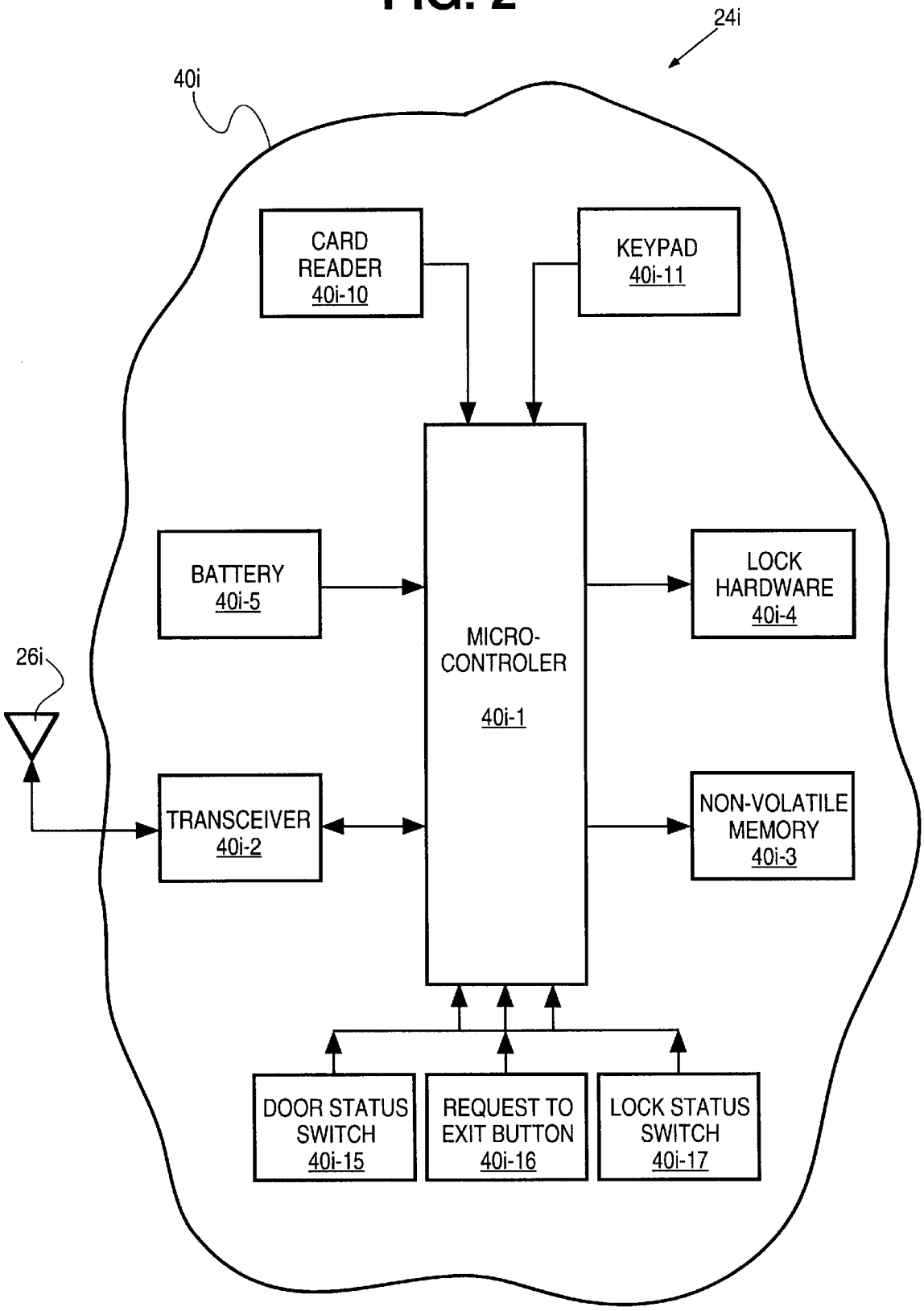
FIG. 2 is a block diagram of an exemplary authorization granting module.

FIG. 2 illustrates, in block diagram form, details of an access granting module 24*i*. In one aspect, the module 24*i* can be used to control access to a region.

The module 24*i* can include a housing 40*i* which could be mounted near or attached to a door or panel, not illustrated, which is normally in a locked state. The module 24*i* is intended to provide to an individual requesting access the ability to open the respective door which is normally locked.

Carried within the housing 40*i* is a programmable processor 40*i*-1. The processor 40*i*-1 is in turn coupled to a transceiver 40*i*-2, non-volatile memory 40*i*-3, controllable lock hardware 40*i*-4 and a source of electrical energy, which could be a lithium battery 40*i*-5.

An authorization request, by an individual seeking access, can be made by a card reader 40*i*-10 or a keypad 40*i*-11, both of which are coupled at the processor 40*i*-1. Other input devices can be provided.

The processor 40*i*-1 receives inputs from a door status switch 40*i*-15, a request to exit switch 40*i*-16 and a lock status sensor or switch 40*i*-17. Other types of environmental related inputs can be provided.

Memory 40*i*-3 is used to store pre-loaded programs as well as other control information. The memory 40*i*-3 could also include various types of magnetic memory if desired.

The memory 40*i*-3 also is used to store an address or an identifier for the unit 24*i*. As is described in more detail subsequently, the identifier is provided to the module 24*i* from the control unit 12 upon request.

In normal operation, an individual requesting access either swipes a card through the card reader 40*i*-10 or enters a pre-assigned code via the keypad 40*i*-11. Controller 40*i*-1 upon sensing the request, transmits by a transceiver 40*i*-2 and antenna 26*i,* its identifier, from memory 40*i*-3, and the identity of the individual seeking access received from either card reader 40*i*-10 or keypad 40*i*-11 to authorization control unit 12. The unit 12 determines that the address or identifier of the module corresponds to one which had previously assigned (multiple modules and multiple access control units can be located in the same vicinity without departing from the spirit and scope of the present invention).

Upon determining that an appropriately identified individual is seeking access via an appropriate module, the control unit 12 transmits to the module 24*i,* perhaps via a respective one of the concentrators 32, an access authorizing signal. Upon receipt of the signal, the controller 40*i*-1 change the state of the lock hardware 40*i*-4 which in turn enables the individual to open the respective door and access the region. A timer can be provided to limit the access interval. Various forms of electrically releasable lock mechanisms can be used without departing from the spirit and scope of the present invention.

The controller 40*i*-1 is able to detect that the door has been opened and subsequently has closed by a sensor or switch 40*i*-15. The lock 40*i*-4 can be relocked subsequent to closure. The relocked condition can be detected by a sensor 40*i*-17.

A simple push button is provided, 40*i*-16 to enable an individual to exit the region. if desired, other types of input devices can be used to control the lock 40*i*-4 for exit purposes.

The module 24*i* can be placed into an address or identifier request state by a manually entered input through a reader 40*i*-10, keyboard 40*i*-11, on power up, or by a separate manually operable switch. In this mode, the controller 40*i*-1 transmits to the unit 12 an address or identifier assigning request. The unit 12, which could have been placed into an appropriate assigning mode via the keypad 16, or which could automatically enter such a mode, will in turn generate an address or identifier and transmit same to the requesting module 24*i*. The received address or identifier is stored in the memory 40*i*-3 for subsequent use. This process facilitates module replacement or expansion as the unit 12 is always in control of its universe of assigned addresses or identifiers.

Figure 3:
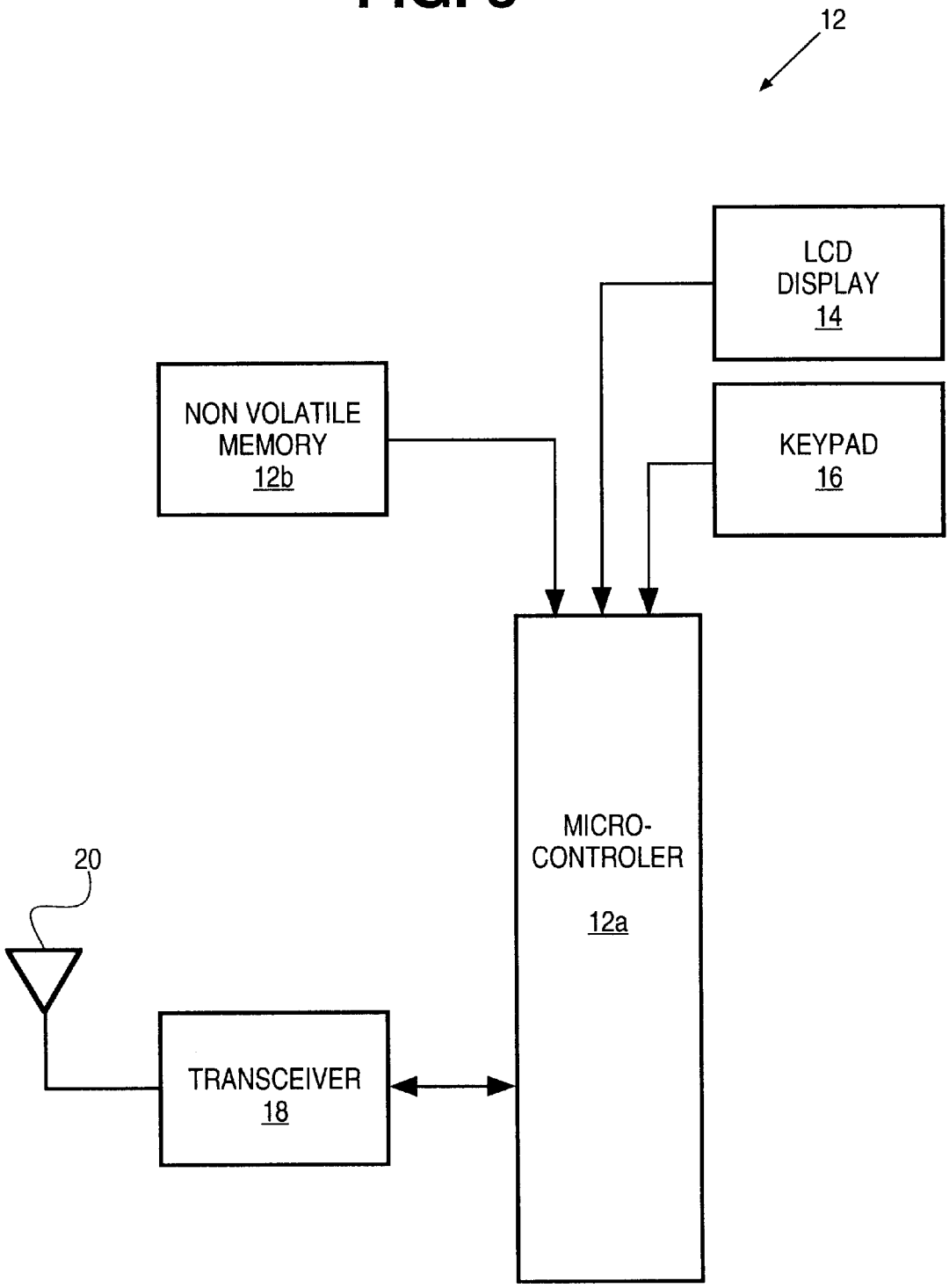
FIG. 3 is a block diagram of an authorization control unit.

FIG. 3 illustrates the unit 12 in more detail. The unit 12 includes a programmed processor 12*a* which is in turn coupled to the display 14, keypad 16, a memory unit 12*b,* and a transceiver 18. The memory 12*b* can be implemented as any form of non-volatile memory which could include magnetic storage as well as semiconductor storage without departing from the spirit and scope of the present invention. As an alternate to the transceiver 18 and the antenna 20, as discussed previously, the processor 12*a* could be connected by one or more sets of cables to one or more concentrators or multiplexers 32.

Figure 4:
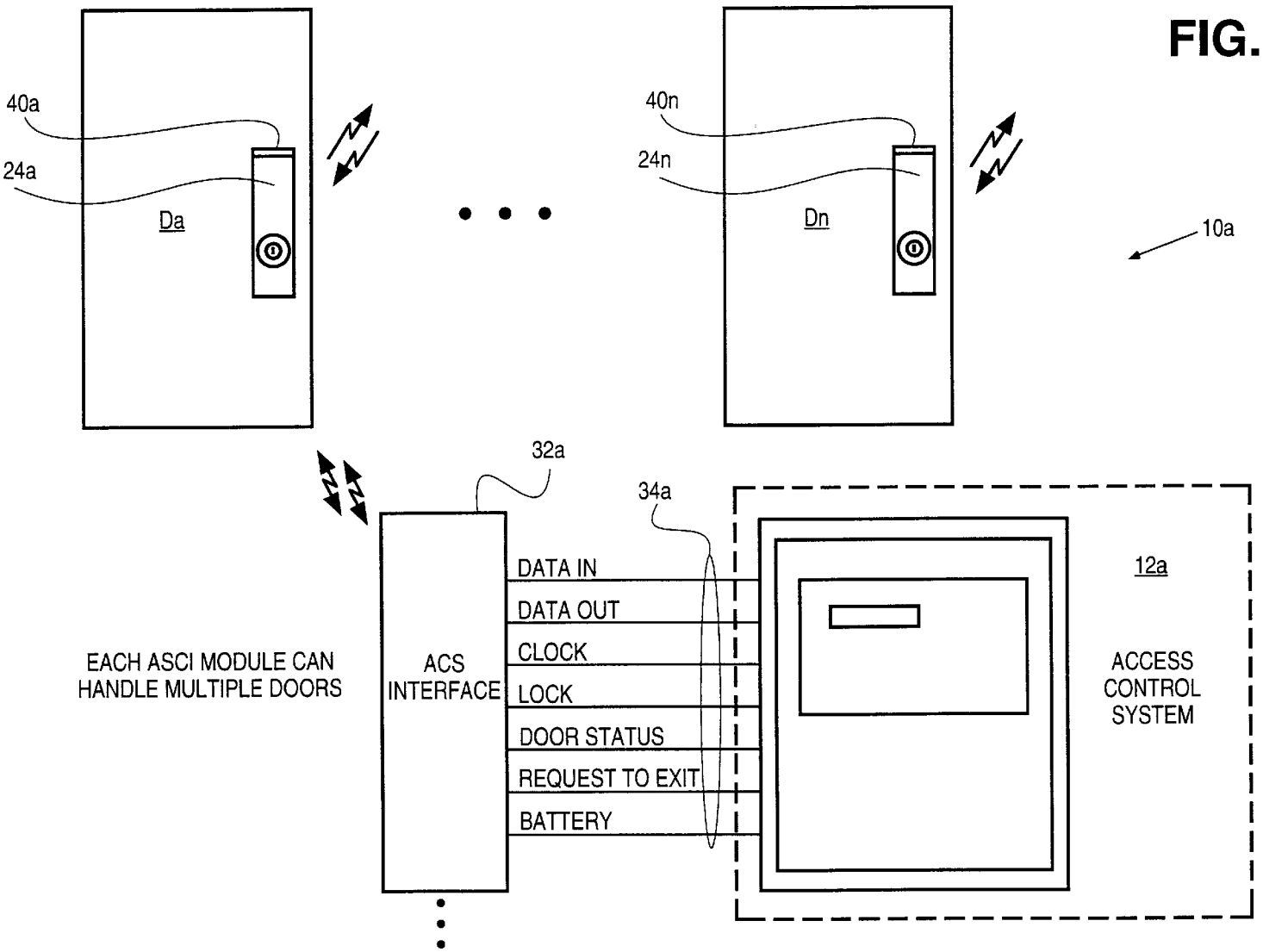
FIG. 4 is a block diagram of an access control system.

FIG. 4 illustrates in more detail a door control system 10*a*. The system 10*a* includes an access control system 12*a,* as discussed previously.

In the implementation illustrated in FIG. 4, the access control system 12*a* is connected by cables 34*a* to a respective access control system interface module 32*a*. The system 12*a* can be so connected to numerous interfaces 32*b* . . . 32*m* if desired.

The interface module 32*a* transmits information to and receives information from the control system 12*a*. It also transmits, wirelessly, access authorizing commands, in response to requests, to associated door modules 24*a* . . . 24*n*. The modules 24*a* . . . 24*n* are mounted on the respective doors Da . . . Dn.

Each of the door modules, such as the module 24*a* is powered by a self-contained source of energy, such as a lithium battery and incorporates a lockable and unlockable mechanical lock structure. Each of the modules 24*a* is required to transfer the identifying information received by a card reader, keyboard or other input devices wirelessly to the associated interface, such as the interface 32*a*. The respective module also includes the circuitry and instructions to lock or unlock the respective door Da in response to instructions it receives from the interface 32*a*. Additional information which can be transferred to the interface 32*a* includes door status, lock status, request for exit having been received and battery power level.

One particular advantage of the system 10*a* lies in the fact that each of the door modules 24*a* . . . 24*n* exhibits an address or identifier requesting mode in response to specific conditions such as power up or entry of particular card or key code. In this mode, a request signal is transmitted to the interface 32*a* which in turn forwards it to the control system 12*a*.

The system 12*a* can be placed into an address providing mode manually or automatically. When in this mode, in response to detecting an address or identifier request, the system 12*a* will generate an appropriate address or identifier which is in turn transmitted, via the interface 32*a,* to the respective module 24*i.* The module in turn stores the address. The access control system 12*a* can process a received address to determine its validity. Alternately, it can store the address in its data base for use subsequently in determining whether or not a received access request has come from an appropriate door module. If not access is denied.

If the request has come from an appropriate module, the transmission is examined further to determine if the identification information identifying the person making the request matches an authorized individual in the access systems data base. If so, an access authorizing command is transmitted via the interface 32*a* to the respective module which in turn releases a lock enabling the individual to open the door and access the region.

Another advantage of the present system lies in the fact that where card access is provided via by the door modules as a card is swiped through the card reader, an interrupt is generated at the respective module which in turn activates the controller, such as the controller 40*i*-1. The controller could then sense as many bits of information as are available form the card being passed through the reader. This information along with the modules address or identifier is then transmitted immediately. Transmission can take place while the individual swiping the card is still in the act of moving the card through the reader.

The module will wait for an access authorizing command from the control system 12*a* before releasing a lock. Additionally, for purposes of extending the life of the energy source, the battery 40*i*-5, the module controller 40*i*-1 is normally in an interactive state. It is periodically activated to request commands or other information via the respective interface, 32*a* or from the control system 12*a*. Since the module controller is usually in an inactive state to conserve power, it must be activated periodically to report to the interface, 32*a* and then to receive commands or other updated information therefrom.

A further advantage lies in the use of low power consumption circuitry in combination with a self-contained energy supply. Coupled with the wireless transmission, the modules are readily mounted on doors, panels or other units without any need for wiring.

Figure 5:
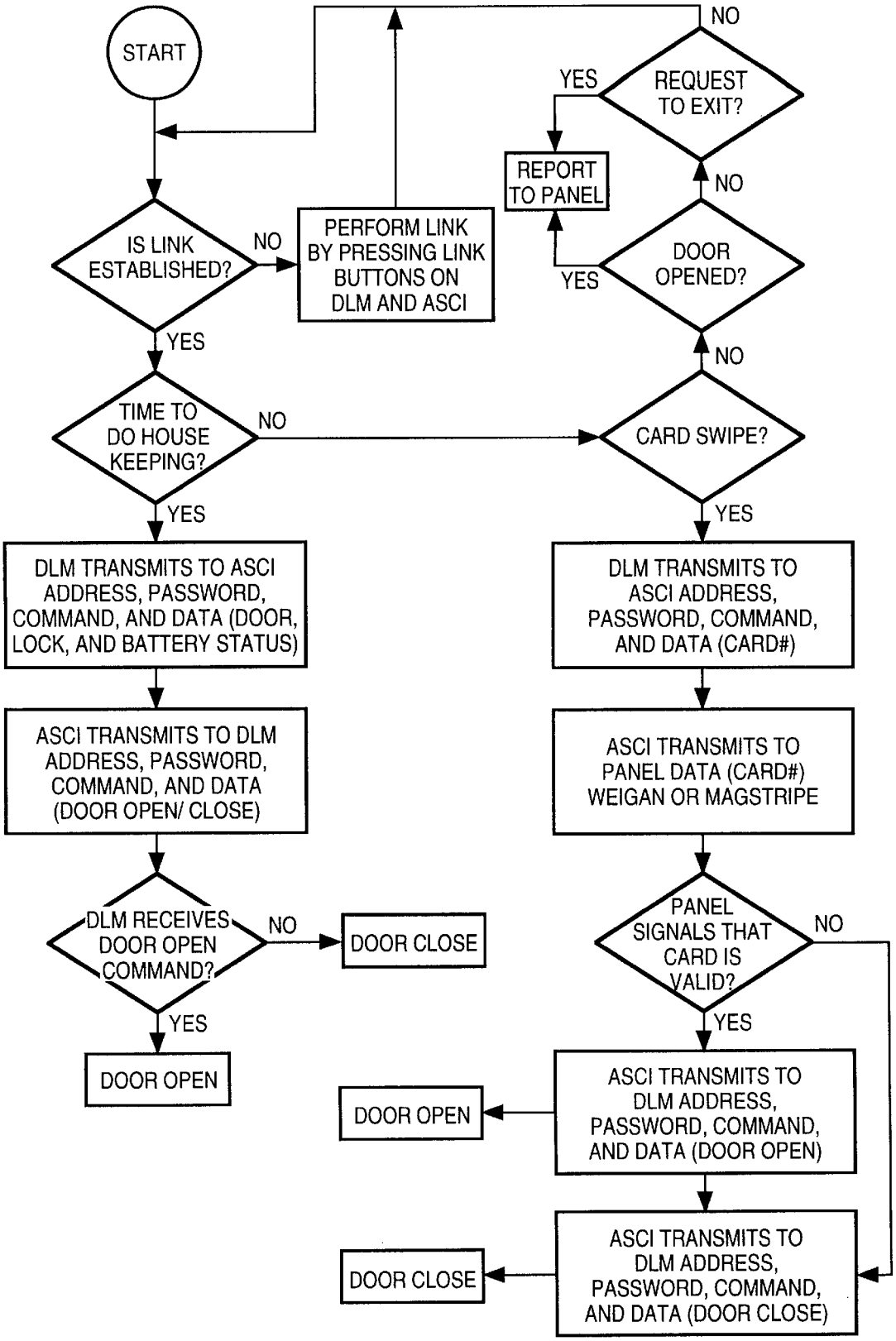
FIG. 5 is a flow diagram illustrating a process of access control implementable with the system of FIG. 4.

FIG. 5 illustrates previously discussed the steps of a process of authorizing access to a region which can be carried out using the system 10*a*. In FIG. 5, the designation DLM corresponds to any one of the modules 24. The designation ACSI corresponds to any one of the interface units 32. Those of skill in the art would understand, as described above, the steps illustrated in FIG. 5 and how the respective modules and the control system 12*a* would be programmed to carry out the indicated steps.

Figure 6:
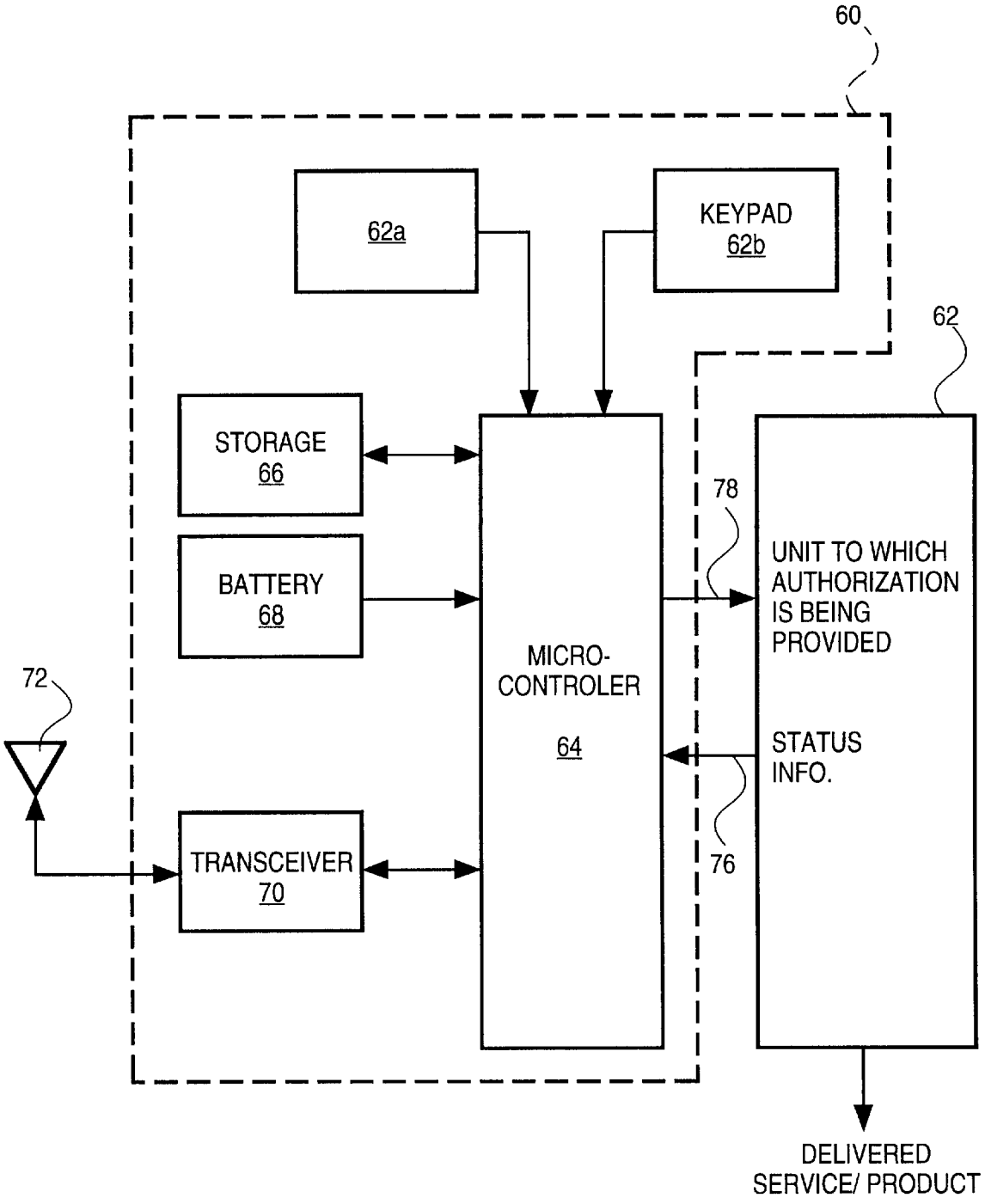
FIG. 6 is a block diagram of a unit to which authorization is to be provided coupled to an authorization granting module.

FIG. 6 is a block diagram of an access authorizing module 60 usable with any one of a variety of devices 62 which might require authorization. Representative units or devices include vending machines, copy machines, telephones, fax machines or the like.

The module 60 includes one or more input devices such as a sensor 62*a* and/or a keypad 62*b*. The sensor 62*a* can be any form of a sensor which can receive external identification information. This include card readers, voice recognition systems, finger print readers, palm readers, video recognition systems and the like without limitation.

The module 60 further includes a programmed processor 64. Coupled to the processor 64 is a storage unit 66, a source of electrical energy 68 and a transceiver 70. The storage unit 66 can include volatile and non-volatile memory including semiconductor memory, programmable read-only memory, or magnetic storage devices. Batteries 68 can be implemented using a long-life lithium type battery. Transceiver 70 is in turn coupled to an antenna 72.

The controller 64 receives status information 76 from the unit. Authorization signals 78 are provided to the unit. The authorization signals 78 are generated as described above with respect to the system 10. In response to the presence of an authorization signal or signals 78, the associated unit 62 is enabled to in turn dispense or provide a requested product, or service.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A module for granting authorization comprising:

a housing;

an enabling member, carried by the housing, wherein the member has first and second states;

a control circuit carried by the housing;

an access request receiving device, coupled to the circuit, for providing an electrical signal indicative of an access request;

a transceiver, coupled to the circuit for wirelessly supplying access requesting identification signals to a remote authorization unit and, for receiving access authorizing signals from the remote unit; and a self-contained power supply carried by the housing for energizing at least the circuit and the transceiver.

2. A module as in claim 1 wherein the control circuit includes circuitry for establishing a transient identifying link with the remote unit.

3. A module as in claim 1 wherein the control circuit includes circuitry for providing status information to the remote unit.

4. A module as in claim 2 wherein the control circuit includes circuitry for storing an identifier received from the remote unit via the identifying link.

5. A module as in claim 1 wherein the enabling member comprises a lock which has at least one portion movable from one position to a second position.

6. A module as in claim 1 wherein the enabling member changes state in response to receipt of an authorizing signal from the remote unit.

7. A module as in claim 4 wherein the control circuit includes further circuitry for comparing at least a portion of a signal received from the remote unit to a prestored identifier and in response to a match, processing other portions of the signal wherein the enabling member changes state in response to the control circuit identifying a received authorizing signal in response to the processing.

8. A module as in claim 7 wherein authorization is granted for a predetermined time internal.

9. A module as in claim 7 wherein the control circuit includes a sensor for detecting physical change in response to the change of state and further circuitry for thereupon causing the enabling member to again change state.

10. A device for enabling a requester to obtain a requested result comprising:

an input device for making a request;

a control unit coupled to the input device;

a transceiver coupled to the control unit includes circuitry for transmitting a request identifying message and a device identifier to a remote authorization unit wherein the device identifier had previously been assigned by and received from the remote authorizing unit.

11. A device as in claim 10 which includes storage circuitry coupled to the control unit for receiving an assigned identifier.

12. A device as in claim 11 which includes a manually controllable input element, coupled to the control unit, wherein the control unit includes circuitry for enabling the control unit to function in a selected identifier requesting mode, in response to a signal from the input unit.

13. A device as in claim 12 wherein the control unit includes circuitry for receiving, from the transceiver, a request enabling signal sent from the remote authorizing unit and for generating a request granting signal in response thereto.

14. A device as in claim 13 which includes a movable lock and wherein the lock is moveable from a first position to a second position in response to the presence of the request granting signal.

15. A device as in claim 14 wherein the lock is manually movable between the positions only in response to the presence of the request granting signal.

16. A device as in claim 10 wherein the input device includes one of a card reader, a keypad, a finger printer reader, a voice recognition unit, a video recognition unit, and a palm reader.

17. A device as in claim 15 which includes an energy source coupled to at least the control unit.

18. A device as in claim 17 wherein the energy source is self-contained.

19. A device as in claim 15 wherein the control unit includes circuitry for permitting the lock to be manually moved once during a predetermined time interval.

20. A system for enabling access comprising:

a plurality of distributable authorizing modules; and an authorization control unit wherein each of the modules and the unit are temporarily in communication in an address assigning mode wherein a unit assigned address is supplied by the unit to the respective module for storage therein.

21. A system as in claim 20 wherein the unit includes an authorized data base.

22. A system as in claim 21 wherein the data base identifies individuals entitled to authorization.

23. A system as in claim 20 wherein at least some of the modules include a transceiver which provides wireless communication with the unit.

24. A system as in claim 20 wherein at least some of the modules include a manually operable control element for placing the respective module into an address receiving mode and for requesting an address from the unit.

25. A system as in claim 24 wherein the unit includes at least one transceiver and circuitry for responding to a module's address request and for assigning an address to the requesting module.

26. A system as in claim 25 wherein the unit includes storage for a module data base of assigned addresses.

27. A system as in claim 26 wherein the unit includes circuitry for accessing the data base and for comparing an address from an access requesting module thereto.

28. A system as in claim 27 wherein the unit includes circuitry for comparing an identifier from a module requesting access to an authorization data base.

29. A system as in claim 28 wherein the unit includes circuitry for detecting the presence of a received identifier in the authorization data base and for generating an authorizing signal to be sent to the requesting module only where the address of that module was found by the unit to be in the module data base.

30. An access authorizing system comprising:

a plurality of authorizing modules;

an access authorizing unit wherein the unit includes circuitry for responding to a transient identifying link initiated by a selected member of the plurality and for transferring an identifier thereto for storage therein.

31. A system as in claim 30 wherein each of the modules is coupled to a respective dispensing apparatus, wherein the apparatus is enabled by a respective module to carry out a predetermined function.

32. A system as in claim 31 wherein at least some of the respective apparatus, when enabled, dispense a selected item.

33. A system as in claim 31 wherein at least some of the modules include circuitry having active, energy consuming, and inactive, relatively lower level energy consuming states and timer circuitry for switching between states on a predetermined basis.

34. A system as in claim 33 wherein at least one of the modules include self-contained sources of energy.

35. An access control system comprising:

a plurality of access granting modules wherein the members of the plurality each include;

an input device for receiving access requesting identification information, a control circuit coupled to the input device, a wireless transceiver coupled to the control circuit, an access permitting element, coupled to the control circuit having at least first and second states; and an access determining unit, displaced from at least some of the modules, wherein the unit includes at least one wireless transceiver and circuits, responsive to a request from a respective module, for assigning an identifier thereto.

36. A system as in claim 35 wherein the module control circuit includes circuitry for entering an identifier assignment requesting state in response to the presence of a selected condition, and for receiving and storing an identifier from the unit.

37. A system as in claim 36 wherein the selected condition corresponds to a physical movement of a portion of the respective module and wherein the module control circuit includes circuitry for detecting that movement and for entering the requesting state in response thereto.

38. A system as in claim 36 wherein the input device is selected from a class which contains a card reader, a keypad, a voice recognizer, an image recognizer, and a finger print reader.

39. A system as in claim 36 wherein at least some of the modules include a self-contained energy source.

40. A system as in claim 39 wherein at least some of the modules include a housing for carrying the energy source.

41. A system as in claim 36 wherein at least some of the access permitting elements each include a movable mechanical lock having a first, locked position, and a second, unlocked position.

42. A device comprising:

a housing;

an enabling element, carried by the housing, wherein the member has first and second states;

a control circuit, coupled to the element and carried by the housing wherein the control circuit includes a device identifier previously received from a remote authorizing unit;

at least one input device, coupled to the control circuit, wherein the input device is selected from a class which includes a card reader, a keypad, a voice detector, a palm scanner and a finger print scanner wherein the input device in response to a received request, couples an electrical signal indicative of that request to the control circuit; and a wireless transceiver, coupled to the control circuit, for wirelessly transmitting a request signal and the previously received device identifier to the remote authorizing unit, and, for receiving an authorizing signal from that unit.

43. A device as in claim 42 which incudes a storage device wherein the previously received device identifier is stored.

44. A device as in claim 43 wherein the control circuit includes a programmed processor.

45. A device as in claim 44 wherein the enabling element includes an electrically controllable lock and wherein a selected control signal is coupled from the control circuit to the lock, causing same to change state, in response to the authorizing signal received from the remote authorizing unit.

46. A device as in claim 42 wherein the enabling element includes an electrically controllable lock.

47. A device as in claim 45 which includes an environmental status indicator.

48. A device as in claim 47 which includes an antenna coupled to the transceiver for bidirectional radio frequency communication.

49. A device as in claim 42 wherein the enabling element enables the providing of one of a selected product and a selected service.

50. An enablement system comprising:

an authorizing unit which includes a list of linked devices wherein a device that has been linked to the unit, by receipt of a linking indicator, receives an enabling command therefrom wherein the authorizing unit includes a transceiver for wireless communication with at least one device;

at least one device having a transceiver for wireless communication with the authorizing unit; a circuit for storage of a linking indicator received wirelessly from the authorizing unit; a control circuit coupled to the transceiver and to the circuit for storage; and at least one output line from the control circuit for providing at least a part of an authorizing signal wherein the control circuit, subsequent to an authorization requesting transmission of at least its linking indicator to the authorizing unit and a responsive enabling command therefrom, generates the at least a part of the authorizing signal on the at least one output line.

51. A system as in claim 50 wherein the device includes at least one of a card reader and a keypad through which an enabling request is entered.

52. A system as in claim 51 wherein the control circuit includes a programmed processor and wherein the circuit for storage comprises a non-volatile memory device.

53. A system as in claim 51 wherein the device includes an environmental sensor, related to the authorizing signal, coupled to the control circuit.

54. A system as in claim 53 wherein the sensor comprises a position indicator.

55. A module as in claim 1 wherein the control circuit includes an element for storing an identifier assigned by the remote authorization unit and wherein the access requesting identification signals include a representation of the identifier.

56. A module as in claim 55 wherein the control circuit exhibits at least first and second states wherein one state is an identifier requesting state wherein an identifier is requested from the remote authorization unit and the other state is an authorization granting state wherein a previously supplied identifier is supplied to the authorization unit.

57. An authorization method comprising:

placing a selected authorization module into an identifier requesting state;

transmitting, wirelessly, an identifier request to a displaced authorization control device;

generating an identifier at the control device in response to a received identifier request;

transmitting, wirelessly, the identifier to the authorization module;

storing the received identifier at the module requesting same;

placing the selected module into another state;

receiving, at the selected module, a locally generated access request; and transmitting at least the stored identifier and the access request to the authorization control device.

58. A method as in claim 57 which includes, at the control device, determining if the request from the module is to be authorized and if so, transmitting at least the identifier and an authorization indicator to the selected module.

59. A method as in claim 58 which includes:

receiving, at the module the identifier and the authorization indicator and, in response thereto, generating a local access enabling signal.

60. A method as in claim 59 wherein the module includes an electrically actuatable release device and wherein receipt of the access enabling signal results in actuation of the release device.

61. A method as in claim 60 wherein the release device comprises an electrically actuated two state lock and the access enabling signal changes the state of the lock from a first state to a second state.

* * * * *

UNITED STATES PATENT AND TRADEMARK OFFICE

CERTIFICATE OF CORRECTION

PATENT NO. : 5,936,544

DATED : Aug. 10, 1999

INVENTOR(S) : Eric V. Gonzales et al

It is certified that error appears in the above-identified patent and that said Letters Patent is hereby corrected as shown below:

Cover page of patent, please correct the surname of the second inventor to read "Charlebois".

Signed and Sealed this

Nineteenth Day of September, 2000

*Attest:*

Q. TODD DICKINSON

*Attesting Officer*

*Director of Patents and Trademarks*